US005630385A

United States Patent [19]

Taomo

[11] Patent Number: 5,630,385

[45] Date of Patent: May 20, 1997

[54] INTERNAL COMBUSTION ENGINE WITH DECOMPRESSION DEVICE

[75] Inventor: Toshio Taomo, Tokyo, Japan

[73] Assignee: Kioritz Corporation, Tokyo, Japan

[21] Appl. No.: 558,881

[22] Filed: Nov. 16, 1995

[30] Foreign Application Priority Data

Nov. 21, 1994 [JP] Japan ..... 6-286621

[51] Int. Cl.[6] ..... F02N 3/02; F02N 17/08

[52] U.S. Cl. ..... 123/182.1

[58] Field of Search ..... 123/182.1

[56] References Cited

U.S. PATENT DOCUMENTS

| | | | |
|---|---|---|---|
| 2,742,380 | 4/1956 | Peters | 123/182.1 |
| 2,947,300 | 8/1960 | Trapp | 123/182.1 |
| 3,687,124 | 8/1972 | Kolorz | 123/182.1 |
| 4,953,526 | 9/1990 | Hironaka et al. | 123/182.1 |
| 5,116,287 | 5/1992 | Hironaka et al. | 123/182.1 |
| 5,211,140 | 5/1993 | Hironaka et al. | 123/65 P |
| 5,361,738 | 11/1994 | Iida | 123/182.1 |
| 5,379,734 | 1/1995 | Tsunoda et al. | 123/182.1 |

*Primary Examiner*—Andrew M. Dolinar

*Attorney, Agent, or Firm*—Armstrong, Westerman, Hattori, McLeland & Naughton

[57] ABSTRACT

The invention provides an internal combustion engine having a decompression device, wherein the decompression device includes a pressure reducing valve, a recoil starter, and a decompression working mechanism. The decompression working mechanism works in association with the motion of the recoil starter means, for opening and closing the pressure reducing valve. The decompression working mechanism includes a rotatable recoil reel with at least one abutting jut disposed on the outer periphery thereof, a decompression lever which is swingably mounted to a fixed member of the internal combustion engine and which is swung, upon abutting against the abutting jut of the recoil reel, and a decompression rod, formed into a crooked-rod which is pivotally supported by the fixed member and which is rotated upon abutting against the decompression lever. Further, the decompression lever and the decompression rod are disposed between the fixed member and a recoil cover which covers the recoil starter member, and are covered with a cylinder cover of the internal combustion engine at the upper portion thereof.

20 Claims, 7 Drawing Sheets

INTERNAL COMBUSTION ENGINE WITH DECOMPRESSION DEVICE

BACKGROUND OF THE INVENTION

The present invention generally relates to an internal combustion engine with a decompression device, such as a small air-cooled two-cycle gasoline engine, especially adapted for a portable or conveyable working machine, such as a chain saw, trimmer, etc. and more particularly, to an automatic decompression device which is mounted to a cylinder portion of the internal combustion engine.

Generally, in such portable or conveyable working machines, an air-cooled two cycle gasoline engine with a recoil starter is used as a power source, which provides reduction in size and weight thereof, and in many cases, the decompression device is mounted to the engine so that the start-up of the engine is facilitated. The foregoing decompression device basically includes a perforation passage which allows a combustion chamber, defined by an inner wall of a cylinder of an engine body, to communicate with the outside, a pressure reducing valve for closing the passage mounted therewithin, and a valve operating member for opening the pressure reducing valve responsive to the start-up operation (cranking period).

Various attempts have been made to provide decompression devices which reduce the pressure inside the cylinder of the engine when starting the engine. In such engines for conveyable working machines, such as a chain saw, a manually operated decompression device, which is to be manually operated every time the engine is started, is normally used. This is because it is necessary for the construction thereof to be simple, compact and sturdy in order to easily operate.

Further, other various attempts have been made to come up with an automatic decompression device which is interconnected to a recoil starter device of the engine. For example, Japanese Utility Model Laid-Open Publication No. Hei 2-139366 teaches an automatic decompression device wherein the swing motion of a swinging lever, responsive to the rotation of a recoil starter, operates an exhaust valve of the decompression device to open so that the air-fuel mixture in a cylinder is released to the outside and the pressure of the combustion chamber can be reduced. Other references, such as Japanese Utility Model Laid-Open Publication No. Hei 2-144665, discloses an automatic decompression device which includes a swinging lever, the tip portion thereof being swung upon contact with a recoil rope of the recoil starter when the recoil rope is drawn, and a push rod reciprocating in accordance with the swing motion of the swinging lever, wherein a pressure reducing valve of the decompression device is made to open by the reciprocation of the push rod so that a gas within the cylinder is released to the outside thereby reducing the pressure of the combustion chamber.

In a conventional decompression device, as described above, if the operating mechanism portion of the pressure reducing valve thereof is exposed and, especially in the case of being adapted for an engine of conveyable working machines, such as a chain saw, it is likely that the operating mechanism portion of the pressure reducing valve of the decompression device will contact external obstacles, such as for example, trees, during operation. This results in the operating mechanism portion of the pressure reducing valve being damaged thereby causing a malfunction thereof. In the manually operated decompression device, because the pressure reducing valve is kept closed before the start-up thereof, it is necessary to push in the pressure reducing valve by hand every time the engine is started so that the gas within the cylinder of the engine can be released. Further, the foregoing conventional automatic decompression device, interconnected to the recoil starter of the engine, has problems in that the structure thereof is complicated and that enough room is needed to allow large displacement of the moving member, such as the swinging lever.

In view of the foregoing disadvantages inherent in the known types of prior art, the present invention solves the above-mentioned problems. Thus, it is an object of the present invention to provide an automatic decompression device, which can be adapted for the internal combustion engine for conveyable working machines, such as a chain saw, wherein the operating mechanism portion of the pressure reducing valve of the decompression device cannot be damaged by contacting external obstacles, such as for example, trees while at work, and to provide the same which is capable of automatically reducing the pressure of the combustion chamber within the cylinder in association with the start-up of the engine, wherein the structure is simplified and compactly made.

SUMMARY OF THE INVENTION

To attain the foregoing objects, an internal combustion engine with a decompression device, according to the present invention basically includes: a decompression member including a pressure reducing valve; a recoil starter member; and a decompression working mechanism, in association with the motion of the recoil starter member, for opening and closing the pressure reducing valve, wherein the decompression working mechanism includes a rotatable recoil reel with at least one abutting jut disposed on the outer periphery thereof; a decompression lever, swingably mounted to a fixed member of the internal combustion engine, which is swung upon abutting against the abutting jut of the recoil reel; and a decompression rod, which is formed as a crooked-rod and which is pivotally supported by the fixed member, the decompression rod being rotated upon abutment against the decompression lever. Further, the decompression lever and the decompression rod are disposed between the fixed member and a recoil cover which covers the recoil starter member, and are covered with a cylinder cover of the internal combustion engine at the upper portion thereof.

In operation, the internal combustion engine with a decompression device of the present invention when constructed as described above operates as follows. The operator manipulates (pulls out) the recoil rope of the recoil starter in order to start-up the engine. The recoil reel rotates while moving the abutting jut to abut against the end portion of the decompression lever, which, in turn, is made to swing. The swinging of the decompression lever rotates the decompression rod, and then the end portion of the decompression rod makes the pressure reducing valve open so that a part of the air-fuel mixture within the combustion chamber of the cylinder of the engine is released, through the discharge aperture, to the outside of the cylinder block, thereby reducing the pressure in the combustion chamber.

BRIEF DESCRIPTION OF THE DRAWINGS

The instant invention will be more fully described and better understood from the following description, taken with the appended drawings, as follows.

DETAILED DESCRIPTION OF THE PREFERRED EMBODIMENT

The preferred embodiment of the present invention will now be described, in detail, with reference to the accompanying drawings.

Figure 1:
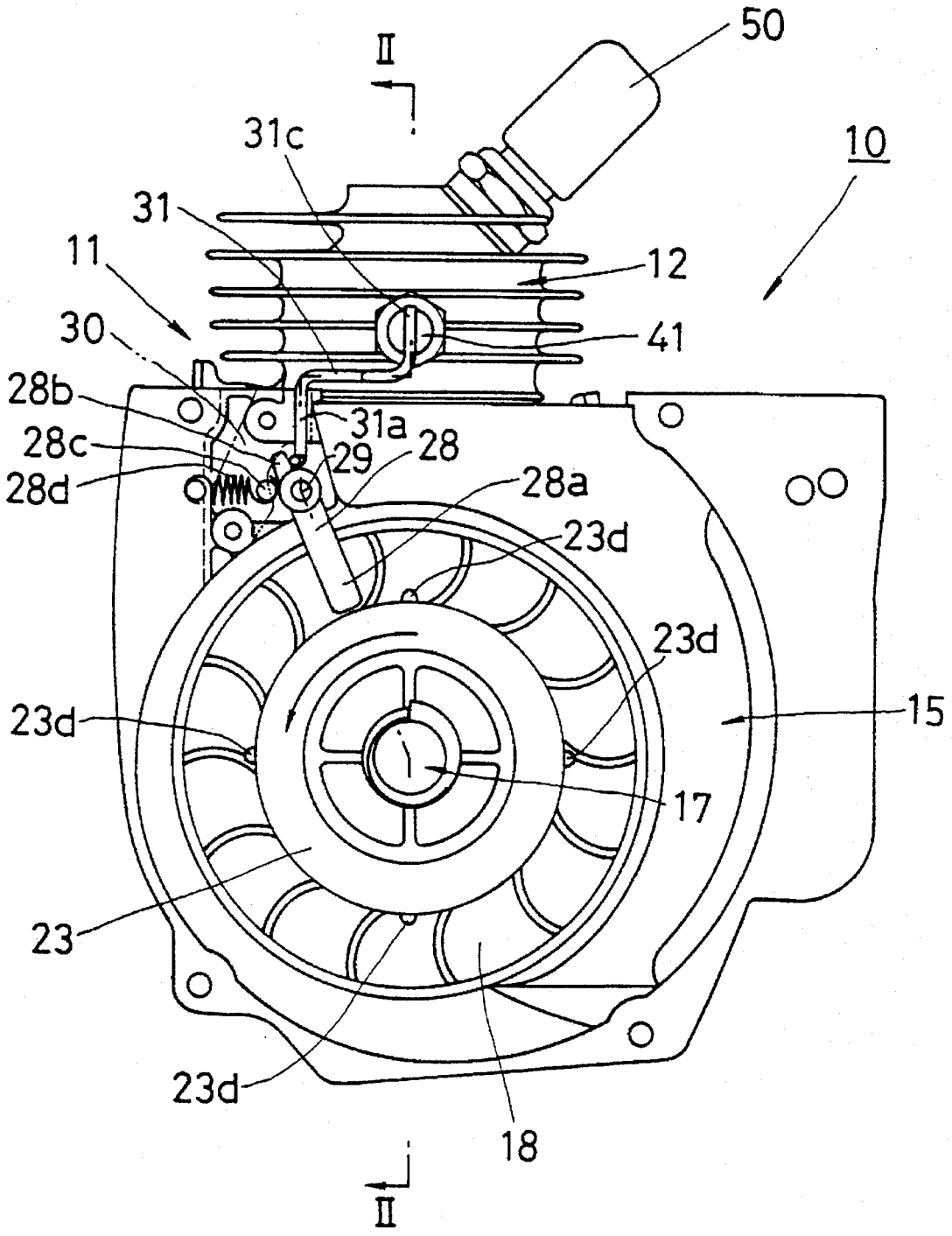
FIG. 1 is a side view of one embodiment of the internal combustion engine with a decompression device according to the present invention, wherein the recoil starter portion and the cylinder head cover are removed therefrom.
Figure 2:
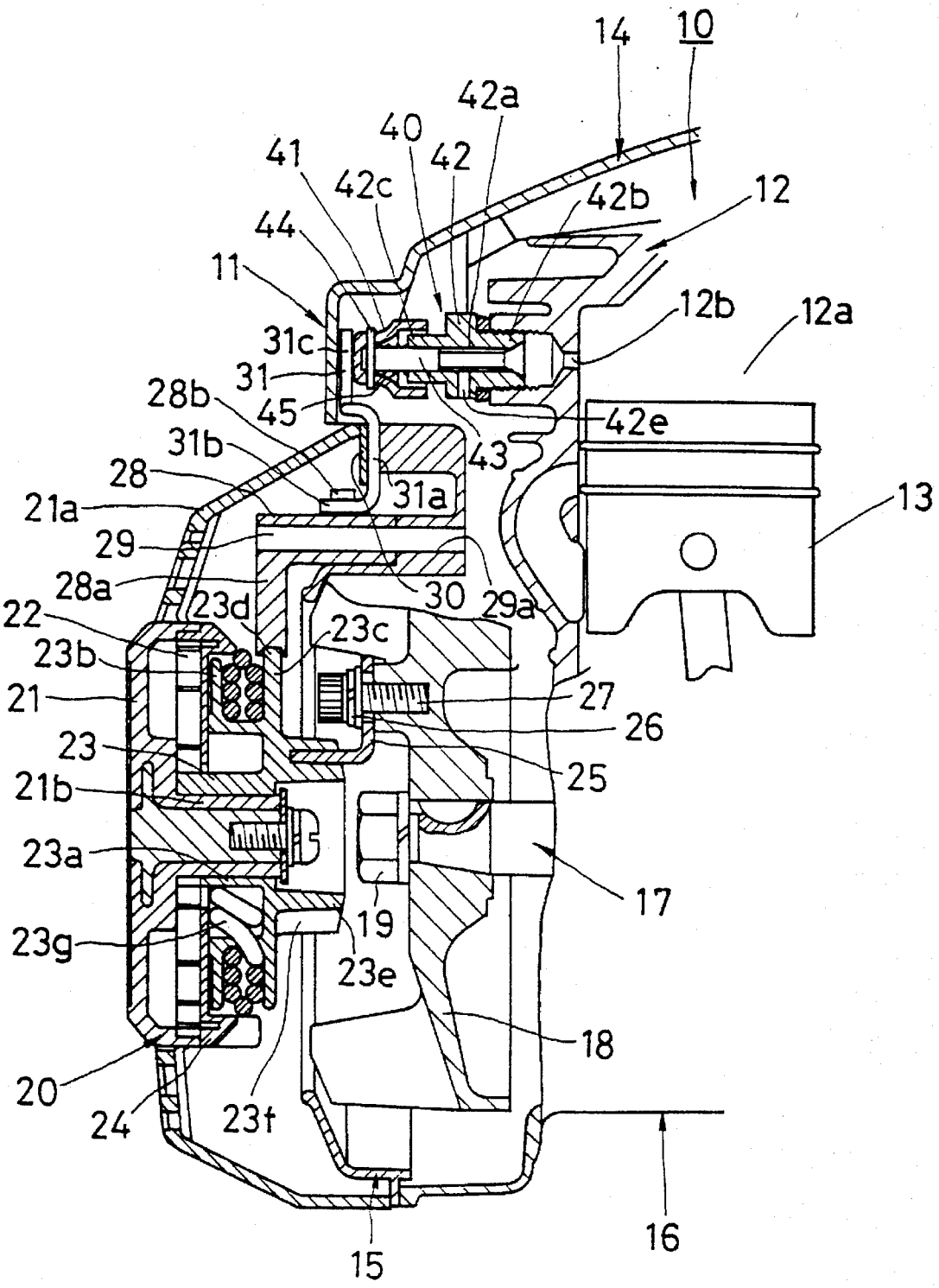
FIG. 2 is an enlarged cross sectional view of the internal combustion engine with a decompression device taken along lines II—II of FIG. 1.

Referring to FIG. 1 and FIG. 2, the internal combustion engine of the illustrated example is a well-known, small air-cooled two-cycle gasoline engine 10, adapted for a chain saw. The gasoline engine 10 includes a cylinder block 12 mounted thereon at the upper portion thereof and a piston 13 slidably reciprocating within the cylinder block 12. The cylinder block 12 includes a spark plug 50 and a decompression device 11 attached thereto at the top portion thereof. The entire upper portion of the cylinder block 12 is covered with a cylinder head cover 14 which is integrally formed of such materials as synthetic resin. A crankcase 16 is attached to the cylinder block 12 at a bottom portion thereof, wherein a crankshaft 17 is rotatably supported by the crankcase 16. A cooling fan 18 is mounted to the crankshaft 17 at one end thereof by means of a nut 19. A fan cover 15 is a fixed stationary member of the engine 10 mounted so that the cooling fan 18 is covered therewith. A recoil starter device 20 is mounted outside the cooling fan 18, in axial alignment with the crankshaft 17. The recoil starter device 20 includes a starter body 21 having a recoil cover **21*a* at the outer periphery thereof, a starter cover plate 24 for fitting into the starter body 21, a recoil spring 22 disposed within the starter cover plate 24 for recoiling a recoil rope 23*g*, and a recoil reel 23 rotatably fitted around a shaft body 21*b* which is formed at the central portion of the starter body 21, wherein the recoil rope 23*g* is wound around the recoil reel 23. The tail end portion (not shown) of the recoil rope 23*g* is guided, passing through the recoil cover 21*a* of the starter body 21 to the outside, to form an operating portion of the recoil starter device 20**.

Figure 7:
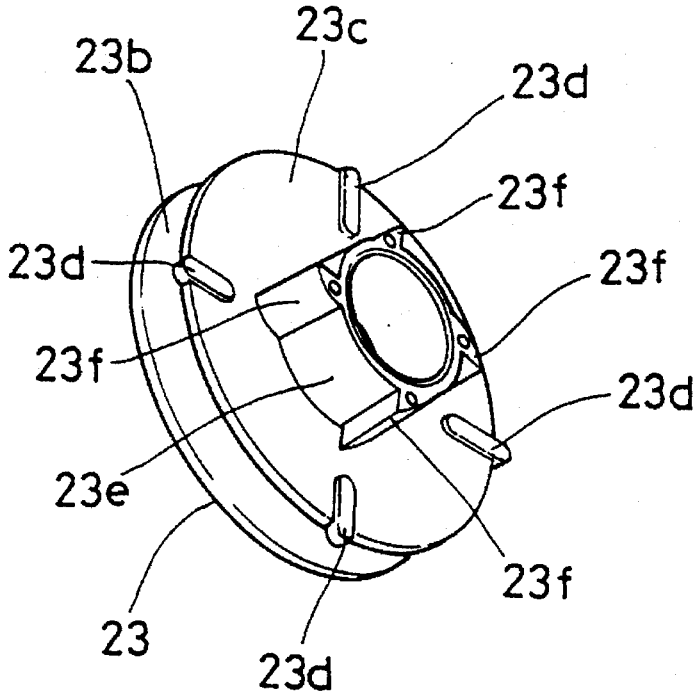
FIG. 7 is a perspective view of a recoil reel of the present invention.

As shown in FIGS. 2 and 7, the recoil reel 23 includes a hub portion **23*a*, rotatably fitted around the shaft body 21*b* of the starter body 21, and two collar portions 23*b*, 23*c*, radially extending from the hub portion 23*a*, wherein the recoil rope 23*g* is wound up between the collar portions 23*b* and 23*c*. Four abutting juts 23*d* are formed, at regular intervals along the outer periphery of the collar portion 23*c* on the side of the cooling fan 18. Further, a ratchet wheel 23*e*, being in axial alignment with the hub portion 23*a*, is formed integrally on the outer surface of the collar portion 23*c*, wherein four ratchets 23*f* are formed on the ratchet wheel 23*e***, at regular intervals along the outer periphery thereof.

The recoil spring 22 is mounted such that the outer peripheral surface thereof is engaged with the starter cover plate 24 while the inner peripheral surface thereof is engaged with the end portion of the hub portion **23*a* of the recoil reel 23. When the tip portion of the recoil rope 23*g* is operated (drawn), the recoil reel 23 rotates in a direction of the arrow shown in FIG. 1, so that this rotation winds up the recoil spring 22 and reserves the restoring power, which, in turn, would work on the recoil rope 23*g* to be wound up when stopping to draw the recoil rope 23*g***.

A centrifugal ratchet 25 is rotatably mounted on the cooling fan 18 at the outer surface thereof through a washer 26 by a hexagon socket head cap screw 27. The centrifugal ratchet 25 is slightly urged into pushing on the ratchet wheel **23*e* of the recoil reel 23** by a spring (not shown).

Figure 4:
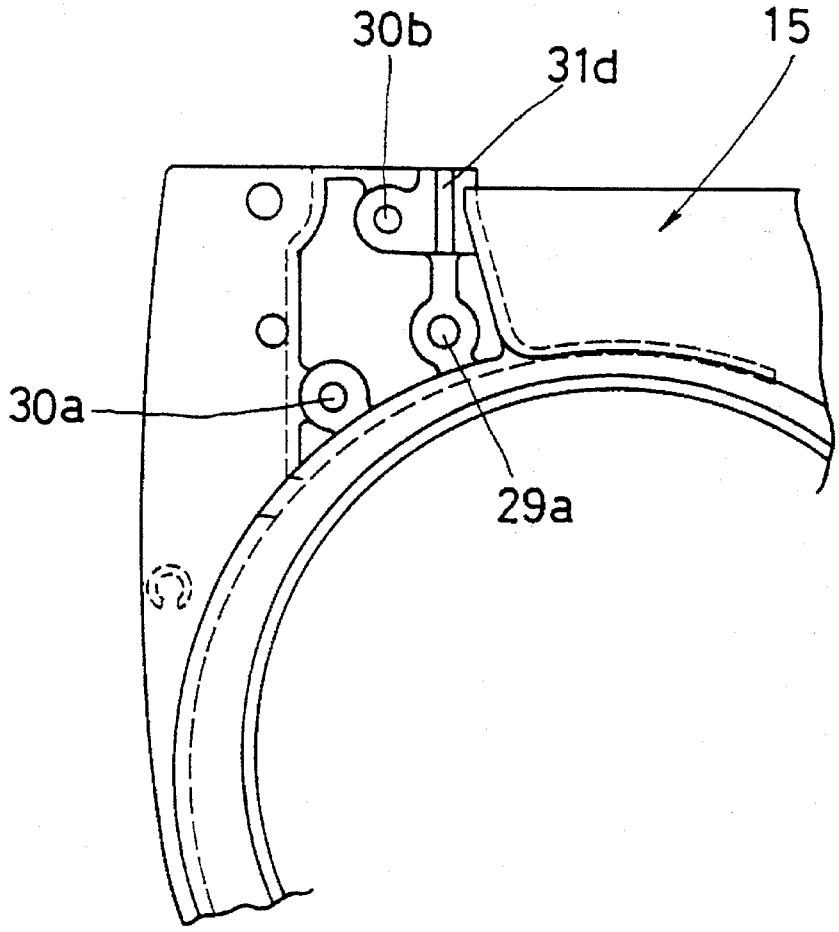
FIG. 4 is a fragmentary side view of the fan cover of the present invention.
Figure 5:
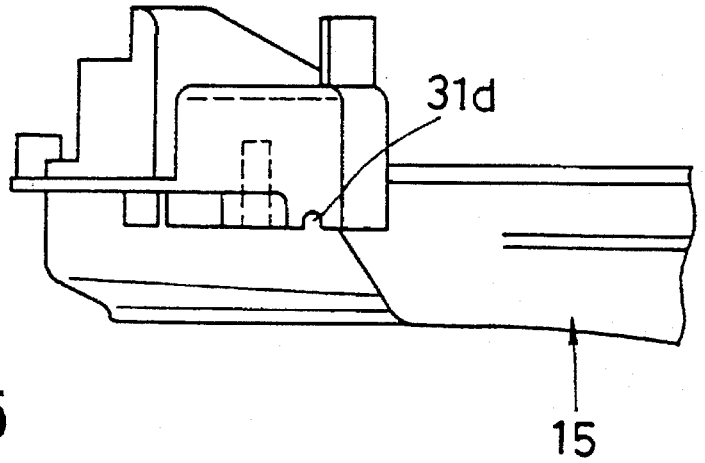
FIG. 5 is a fragmentary plan view of the fan cover of the present invention.

FIGS. 4 and 5 show enlarged fragmentary views of the fan cover 15 which includes a hole **29*a* for screwing a supporting pin 29 of a decompression lever 28 (described later) and holes 30*a* and 30*b* for fixing a cover plate 30 (described later). Further, the fan cover 15 includes a groove 31*d* with a U-shaped cross section, which serves as a guiding holder for rotatably supporting a decompression rod 31 (described later) with respect to the axis thereof between the groove 31*d* and the cover plate 30**.

The decompression lever 28 is pivotally mounted to the supporting pin 29 at the upper portion of the fan cover 15. The decompression lever 28 integrally includes a swinging rod **28*a* elongated downwardly, an abutting jut 28*b* elongated upwardly, and a short pin 28*c* for mounting a coil spring 28*d* which urges the lower end of the swinging rod 28*a*** in an opposite direction of the arrow shown in FIG. 1.

It should be noted that a springy strip, instead of the coil spring **28*d*, may be integrally pre-formed on the decompression lever 28** itself.

Figure 6:
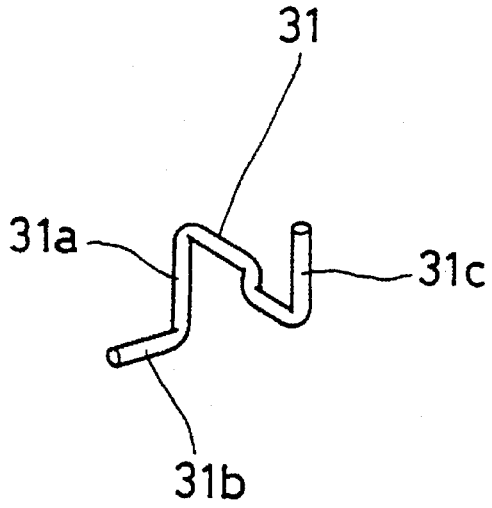
FIG. 6 is a perspective view of the decompression rod of the present invention.

FIG. 6 is a perspective view of the decompression rod 31 which includes a lower end portion **31*b* elongated outwardly and parallel to the crankshaft 17, an intermediate portion 31*a* elongated upwardly from the lower end portion 31*b* vertical thereto, and an upper end portion 31*c* elongated rearwardly from the intermediate portion 31*a* and upturned parallel thereto at the rear end, to form a crooked bar made of steel. The lower end portion 31*b* of the decompression rod 31 is disposed to abut the abutting jut 28*b* of the decompression lever 28. The intermediate portion 31*a* is disposed within the groove 31*d* of the fan cover 15 and is covered with the cover plate 30 so that the decompression rod 31 is rotatably supported about the axis of the intermediate portion 31*a*. While the upper end portion 31*c* of the decompression rod 31 is disposed to abut the thrust case 41 of the pressure reducing valve 40**.

Figure 8:
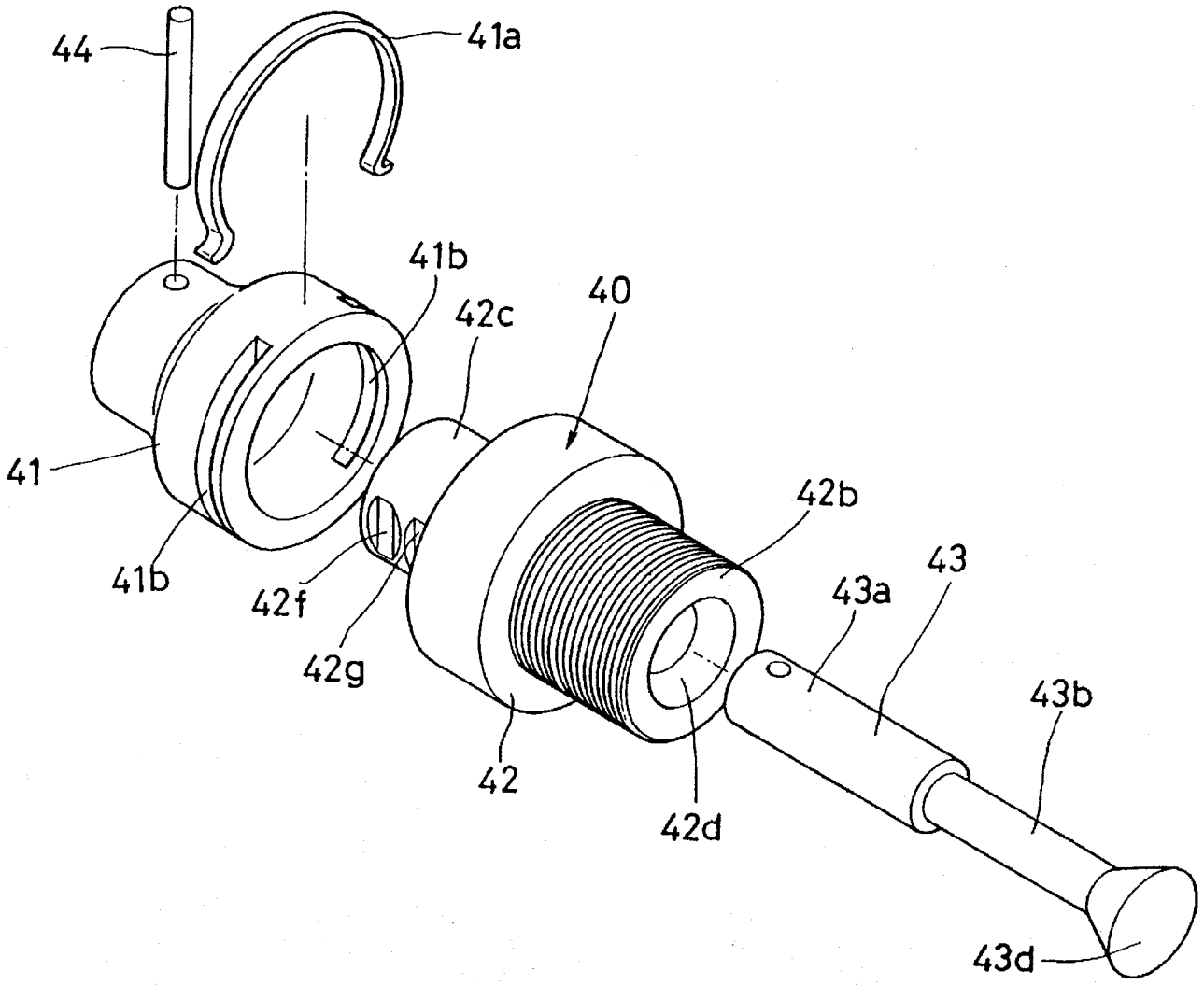
FIG. 8 is an exploded perspective view of the pressure reducing valve of the present invention.
Figure 9:
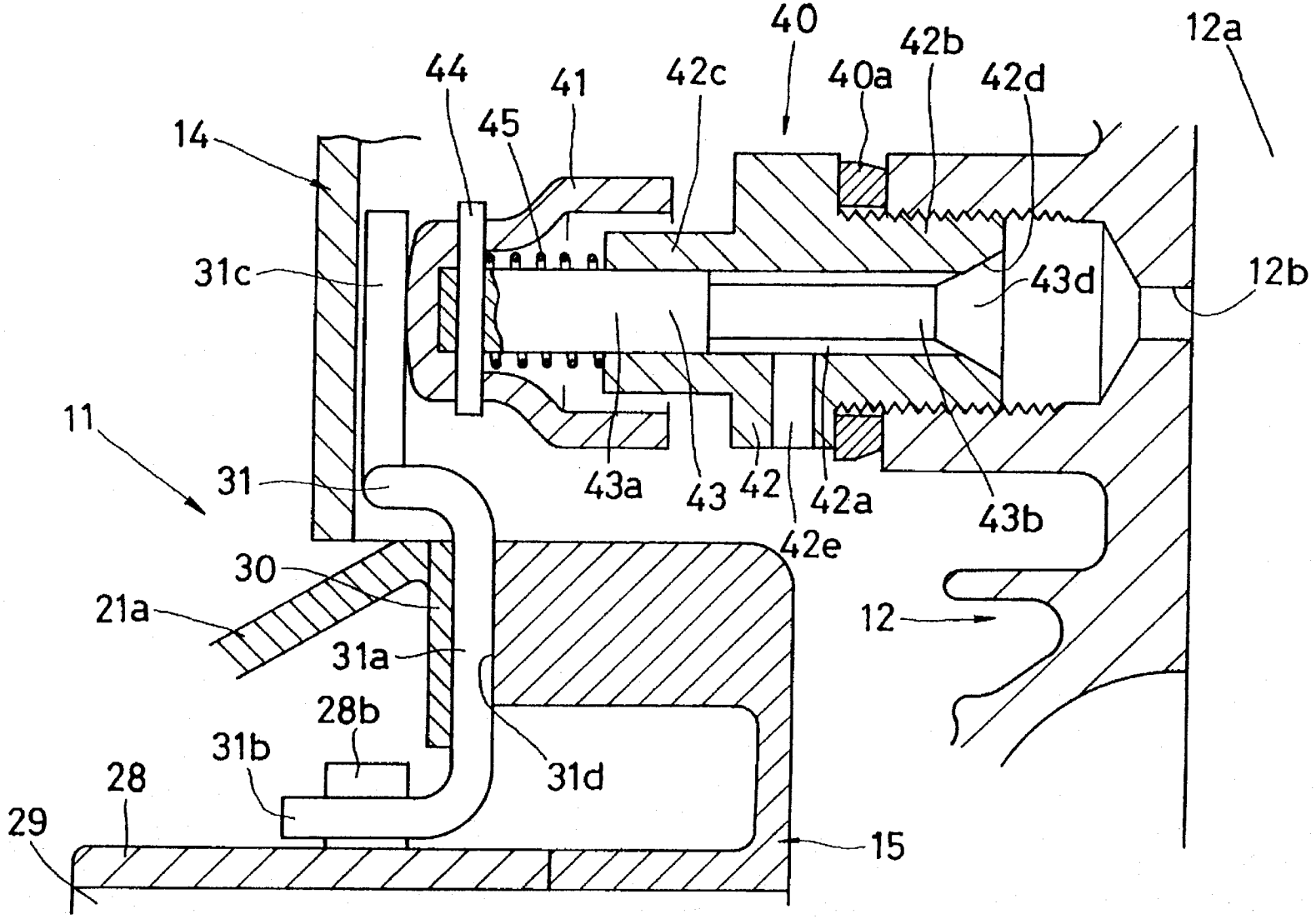
FIG. 9 is an enlarged cross sectional view of the decompression device of the present invention.

FIG. 8 and FIG. 9 show, in detail, the pressure reducing valve 40 of the decompression device 11. The pressure reducing valve 40 of the decompression device 11 leaves a passage **12*b*, formed at a wall portion of a combustion chamber 12*a* of the cylinder block 12 open to the outside, thereby reducing the compressive pressure therewithin. The pressure reducing valve 40 comprises the thrust case 41, a valve body 42, a valve shaft 43, a set pin 44, a U-shaped spring clip 41*a* and a coil spring 45**.

The valve body 42 includes a bore **42*a* axially elongated therethrough, a screw portion 42*b* for screwing the valve body 42 through a washer 4O*a*, on the screw hole which is in axial alignment with the passage 12*b* of the cylinder block 12 at one end thereof, and an engaging portion 42c for loosely fitting the thrust case 41 therearound at the other end thereof. Further, the engaging portion 42c includes two positioning grooves 42f, 42g, parallel to each other in a direction perpendicular to the axis thereof, at the outer periphery thereof, for engaging with a U-shaped clip 41a that is inserted in the thrust case 41. Furthermore, the bore 42a includes a valve seat 42d formed at the end portion thereof on the side of the screw portion 42b and a gas discharge aperture 42e, extending downwardly to communicate between the bore 42a** and the outside, at the central portion thereof.

The valve shaft 43 includes a sliding shaft body 43a guided by the bore 42a of the valve body 42 and slidably reciprocating therewithin, a small diameter shaft body 43b having a smaller outer diameter than that of the sliding shaft body 43a and being disposed within the bore 42a to form a discharge passage for a gas therebetween, and a conical valve body 43d mounted at the tip portion of the small diameter shaft body 43b for being seated at the valve seat 42d.

The thrust case 41 is connected to the valve shaft 43 by a set pin 44. The coil spring 45, biasing the conical valve body 43d of the valve shaft 43 to its closed position, is interposed between one end of the valve body 42 and the thrust case 41. The U-shaped clip 41a is inserted from above into a pair of slotted grooves 41b, 41b formed on both sides of the thrust case 41, and thereafter is engaged with either of the two grooves 42f or 42g.

Next, the operation of the decompression device according to the disclosed embodiment of the present invention will now be described.

When the recoil rope 23g of the recoil starter device 20 is pulled out forcibly in order to start the engine 10, the recoil reel 23 rotates in the direction of the arrow in FIG. 1. The rotational torque generated by the rotation of the recoil reel 23 is imparted to the centrifugal ratchet 25 of the cooling fan 18 press-abutting on the ratchet 23f of the recoil reel 23 to rotate the cooling fan 18, and the crankshaft 17 rotates so that the engine 10 is made to start.

Figure 3:
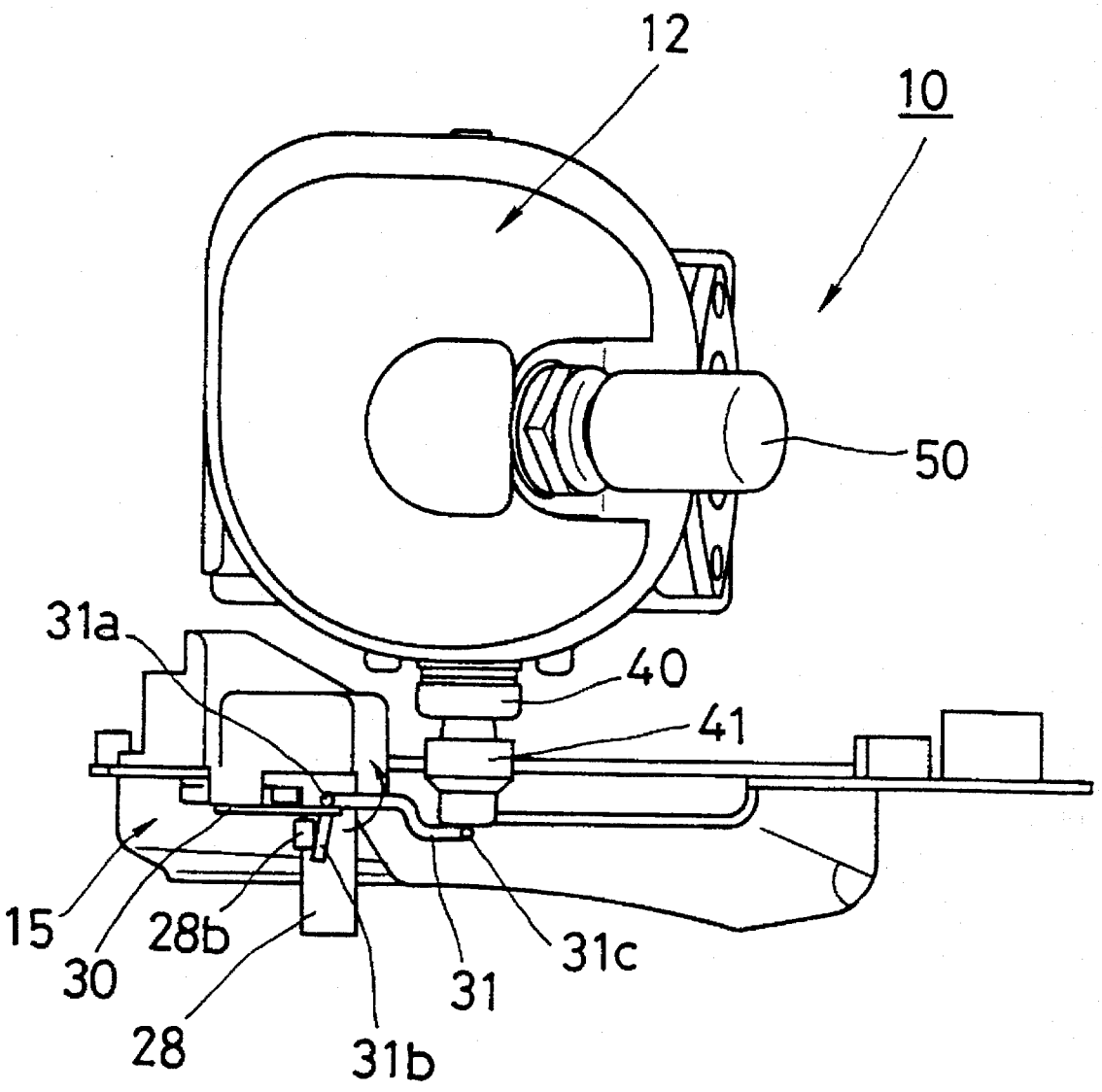
FIG. 3 is a plan view of the internal combustion engine with a decompression device of FIG. 1.

In the process for starting the engine 10, the rotation, in the direction of the arrow in, FIG. 1, of the recoil reel 23 makes the abutting juts 23d repeatedly abut against the lower end portion of the swinging rod 28a of the decompression lever 28 to rotate the swinging rod 28a in a clockwise direction as viewed in FIG. 1. Because the abutting jut 28b, the upper end portion of the decompression lever 28, is moved rearward by the swing of the swinging rod 28a, the decompression rod 31 is made to rotate in a counterclockwise direction as viewed in FIG. 3. By rotational motion of the decompression rod 31, the upper end portion 31c of the decompression rod 31 thrusts the thrust case 41, moving the valve shaft 43 rightward, as viewed in FIGS. 2 and 9, and releasing the conical valve body 43d from the valve seat 42d to open the pressure reducing valve 40, so that the air-fuel mixture within the combustion chamber 12a of the cylinder block 12 is discharged to the outside through the bore 42a and the gas discharge aperture 42e. This discharge of the air-fuel mixture enables the compressive pressure of the combustion chamber 12a to be reduced, thereby allowing the piston 13 to smoothly reciprocate and facilitating the start-up of the engine.

As will be apparent, because the recoil reel 23 includes plural abutting juts 23d, the process of opening the pressure reducing valve 40 is performed many times during one operation of the drawing of the recoil rope 23g, thereby assuring the working of the decompression device 11.

The U-shaped clip 41a, mounted on the thrust case 41, is engaged with the outer groove 42f of the engaging portion 42c of the valve body 42 before the thrust imposed by the decompression rod 31 so that the valve shaft 43 is kept in its closed position, as shown in FIG. 2 and FIG. 9, while the U-shaped clip 41a is switched to engagement with the inner groove 42g as the thrust case 41 moves rightward, as viewed in FIG. 8, so that the valve shaft 43 is kept in its open position.

When operated as described above, the pulling of the recoil rope 23g of the recoil starter device 20 is performed to provide the crankshaft 17 of the engine 1O with some degree of rotational speed known as, the restoring power. The restoring power is reserved in the recoil spring 22 which has been wound during the pulling of the recoil rope 23g to rotate the recoil reel 23 in a reverse direction so that the recoil rope 23g is wound to restore it to its start-up position.

With the above mentioned operation, the thrust pressure on the thrust case 41 of the decompression rod 31 disappears, and the engine 10 begins a self-rotation while the crankshaft 17 is rotating by means of the inertia force of the cooling fan 18 and the like. This results in a completion of the start-up operation. When the engine 10 rotates by itself and an explosion occurs within the combustion chamber 12a, the explosion makes the valve body 43 of the pressure reducing valve 40 automatically move toward its closed position, in a leftward direction as viewed in FIG. 2 and FIG. 9, so that the conical valve body 43d is seated at the valve seat 42d. With the movement of the thrust case 41, the U-shaped clip 41a, mounted on the thrust case 41, resumes its pre-thrust position to be engaged with the outer groove 42f so that the pressure reducing valve 40 is assured to remain in its closed position.

It should be noted that a member for positioning the valve shaft 43, which includes of the U-shaped clip 41a, the slotted grooves 41b, 41b, and two rows of grooves 42f, 42g, is provided in order for the decompression device to work more assuredly. Thus, the omission of such positioning member would not cause any practical trouble because the operation of the decompression device 11 is reiterated during the rotation of the recoil reel 23.

It should be noted that the decompression device 11 according to the present invention, is not limited to be adapted for a portable or conveyable working machine, such as a chain saw or trimmer, but may be adapted for other internal combustion engines in general.

Further, the decompression device 11 including the pressure reducing valve 40 or the recoil starter device 20, is not limited to the embodiment described above, but the present invention can employ various constructions thereof.

As hereinbefore pointed out, in an engine with a decompression device, because a decompression working mechanism including at least one abutting jut of a recoil reel, a decompression lever and a decompression rod is disposed between the fan cover and the recoil cover, in addition to the decompression device itself being housed within the cylinder head cover, it is possible to simplify and downsize the construction of the decompression working mechanism, for easy manipulation and assemblage, and to prevent the working mechanism from being damaged by bumping against external obstacles, such as for example, trees and grasses, during operation.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An internal combustion engine for powering a portable working machine comprising:

an automatic decompression device including a pressure reducing valve;

a recoil starter; and a decompression working means for opening and closing said pressure reducing valve, said decompression working means working in association with said recoil starter;

said decompression working means comprising a rotatable recoil reel decompression lever means, swingably mounted to a fixed member of said internal combustion member for swinging upon abutment against said abutting jut of said recoil reel, and a decompression rod means for opening or closing said pressure reducing valve in accordance with rotation of said recoil reel, said decompression rod means being a crooked-rod which is pivotally supported by said fixed member and which is rotated upon abutment against said decompression lever.

2. An internal combustion engine for powering a portable working machine comprising:

an automatic decompression device including a pressure reducing valve;

a recoil starter; and a decompression working means for opening and closing said pressure reducing valve in association with rotation of said recoil starter, wherein said decompression working means comprises a rotatable recoil reel with at least one abutting jut disposed on an outer periphery thereof, a decompression lever means which is swingably mounted to a fixed member of said internal combustion engine for swinging upon abutment against said abutting jut of said recoil reel, and a decompression rod means for rotation upon abutment against said decompression lever means, said decompression rod means being a crook-rod which is pivotally supported by said fixed member.

3. The internal combustion engine as recited in claim 1 or 2, wherein said decompression lever means and said decompression rod means are disposed between said fixed member and a recoil cover which covers said recoil starter, and are covered with a cylinder cover of said internal combustion engine at an upper portion thereof.

4. The internal combustion engine as recited in claim 1 or 2, further comprising a means for controlling opening or closing of said pressure reducing valve.

5. The internal combustion engine as recited in claim 1 wherein said pressure reducing valve includes a hollow valve body having two ends with a first end connected to a hollow screw portion and a second end connected to a hollow engaging portion so as to form a continuous bore therethrough.

6. The internal combustion engine as recited in claim 5 wherein said screw portion has a valve seat and a means for slidably reciprocating therethrough a valve shaft connected to a smaller diameter shaft body which in turn is connected to a conical valve body.

7. The internal combustion engine as recited in claim 6 wherein said conical valve body abuts said valve seat to close off said pressure reducing valve from a combustion chamber.

8. The internal combustion engine as recited in claim 7 wherein said hollow engaging portion connected to said second end of said valve body includes an outer groove and an inner groove.

9. The internal combustion engine as recited in claim 8 wherein said engaging portion is capable of sliding reciprocation within a thrust case.

10. The internal combustion engine as recited in claim 9 wherein said thrust case houses a coil spring and has aperture means for accepting a set pin.

11. The internal combustion engine as recited in claim 10 wherein said set pin engages said aperture means and a sliding shaft body of said valve shaft.

12. The internal combustion engine as recited in claim 11 wherein said screw portion of said valve body is screwed into a threaded aperture of said cylinder block.

13. The internal combustion engine as recited in claim 12 further comprising a passage between said threaded aperture of said cylinder block which passage leads to said combustion chamber.

14. The internal combustion engine as recited in claim 13 further comprising an annular washer positioned around said screw portion and located between said cylinder block and said valve body.

15. The internal combustion engine as recited in claim 14 wherein said valve body has a gas discharge aperture.

16. The internal combustion engine as recited in claim 15 wherein said continuous bore of said pressure reducing valve is of a larger diameter than said small diameter shaft body which is housed in said continuous bore when said conical valve body abuts said valve seat to close said pressure reducing valve.

17. The internal combustion engine as recited in claim 16 wherein said thrust case abuts an upper end portion of said decompression rod means which is housed within said cylinder head cover.

18. The internal combustion engine as recited in claim 17 further comprising a spring clip wherein said spring clip cooperate with a slotted groove located in said thrust case and said groove in said engaging portion to hold said engaging portion within said thrust case.

19. The internal combustion engine as recited in claim 18 wherein said gas discharge aperture of said valve body communicates with said continuous bore through said screw portion, said valve body and said engaging portion of said pressure reducing valve.

20. The internal combustion engine as recited in claim 3 further comprising a means for controlling opening or closing of said pressure reducing valve.

* * * * *